US006935231B2

(12) United States Patent
Naritomi

(10) Patent No.: US 6,935,231 B2
(45) Date of Patent: Aug. 30, 2005

(54) STAMP

(75) Inventor: Masanori Naritomi, Tokyo (JP)

(73) Assignee: Taisei Plas Co., Ltd., Tokyo (JP)

( * ) Notice: Subject to any disclaimer, the term of this patent is extended or adjusted under 35 U.S.C. 154(b) by 0 days.

(21) Appl. No.: 10/250,302

(22) PCT Filed: Nov. 2, 2002

(86) PCT No.: PCT/JP02/11448

§ 371 (c)(1),
(2), (4) Date: Jun. 30, 2003

(87) PCT Pub. No.: WO03/037640

PCT Pub. Date: May 8, 2003

(65) Prior Publication Data

US 2004/0045456 A1 Mar. 11, 2004

(30) Foreign Application Priority Data

Nov. 2, 2001 (JP) ..... 2001-338186

(51) Int. Cl.[7] ..... B41J 27/00

(52) U.S. Cl. ..... 101/105; 101/103; 101/104; 101/109; 101/111; 101/327

(58) Field of Search ..... 101/101, 103, 101/104, 105, 108–109, 111, 334, 98, 327, 333, 94

(56) References Cited

U.S. PATENT DOCUMENTS

| | | |
|---|---|---|
| 3,380,378 A | 4/1968 | Edwards et al. |
| 5,237,919 A | 8/1993 | Kinstrey et al. |

FOREIGN PATENT DOCUMENTS

| | | |
|---|---|---|
| JP | 62-033080 | 2/1987 |
| JP | 6-27428 | 7/1994 |
| JP | 7-26129 | 6/1995 |

*Primary Examiner*—Andrew H. Hirshfeld
*Assistant Examiner*—Marissa Ferguson
(74) *Attorney, Agent, or Firm*—Arent Fox PLLC

(57) ABSTRACT

A stamp, comprising a stamping case; a rail provided inside said stamping case, having a locus of making a U-turn on a stamping surface of a stamp; and a strip belt for sliding along said rail by being engaged with the rail, attached a plurality of stamping surfaces at predetermined intervals and provided with a tab protruding outside of said stamping case.

3 Claims, 8 Drawing Sheets

STAMP

BACKGROUND OF THE INVENTION

1. Field of the Invention

The present invention relates to a stamp for stamping a mail address, date, telephone number, etc., particularly relates to a stamp having a stamping surface being attached to a strip belt.

2. Description of the Related Art

As a date stamp for stamping a date, etc., those having a ring belt or a closed belt are generally used. For example, a rotation type stamp capable of selecting a desired stamping surface by putting ring belts in parallel around a supporting base so as to be able to freely slide and operating a tab provided on an outer circumferential surface of the belt has proposed in the Japanese Utility Model Publication No. 6-27428. Other than that, there are proposed rotation type stamps having a ring belt in the Japanese Unexamined Utility Model Publication No. 3-62863 and the Japanese Utility Model Publication No. 7-53981.

Those rotation type stamps having a ring belt as above are assembled by putting each belt on a supporting base while straining it, which is extremely troublesome. Particularly, when fitting the belt on the supporting base while straining it, a tool exclusively for straining the belt is necessary.

Also, due to an error in production of the ring belt and the supporting base, the belt fitted on sometimes becomes lax or inversely too tight in the rotation type stamps having a ring belt. As a result, operationality becomes uneven at the time of selecting a desired stamping surface.

SUMMARY OF THE INVENTION

An object of the present invention is to provide a stamp having excellent assembling performance and operationality.

To attain the above object, according to the present invention, there is provided a stamp comprising a stamping case; a rail provided inside said stamping case, having a locus of making a U-turn on a stamping surface of a stamp; and a strip belt for sliding along said rail by being engaged with the rail, put thereon a plurality of stamping surfaces at predetermined intervals and provided with a tab protruding outside of said stamping case.

In the above invention, while not particularly limited, the rail is assembled by combining a plurality of divided sub rails.

Also, in the above invention, while not particularly limited, the strip belt is comprised of a plurality of sub belts to be engaged with the respective sub rails.

A stamp according to the present invention is assembled by combining and setting a plurality of divided sub rails in a stamp case, and then, inserting strip belts from open ends of the respective sub rails. Accordingly, it becomes unnecessary to strain the belts to assemble as done in the case of using a ring belt and only a simple insertion work is necessary, so the assembling performance widely improves.

Furthermore, durability (lifetime) of the belt improves because the belt is not strained and the operationality of selecting stamping surfaces depends only on an engagement state of the belt and rail, so unevenness in production becomes small and the operationality improves.

BRIEF DESCRIPTION OF THE DRAWINGS

These and other objects and features of the present invention will be explained in more detail with reference to the attached drawings, in which.

DESCRIPTION OF THE PREFERRED EMBODIMENTS

Below, an embodiment of the present invention will be explained based on the drawings.

Note that as a stamp 1 of the present embodiment, an example is taken from those having a plurality of stamping surfaces 51 to 54 on each of belts 41 to 44 arranged in four lines for stamping four-digit figure, etc., but the digit number is not particularly limited and 5 or more belts 4 can be provided in the same method as will be explained below to compose a stamp 1 for stamping five-digit or more figures, etc. Also, the stamp is not limited to figures but may be a letter or a pattern.

Figure 1:
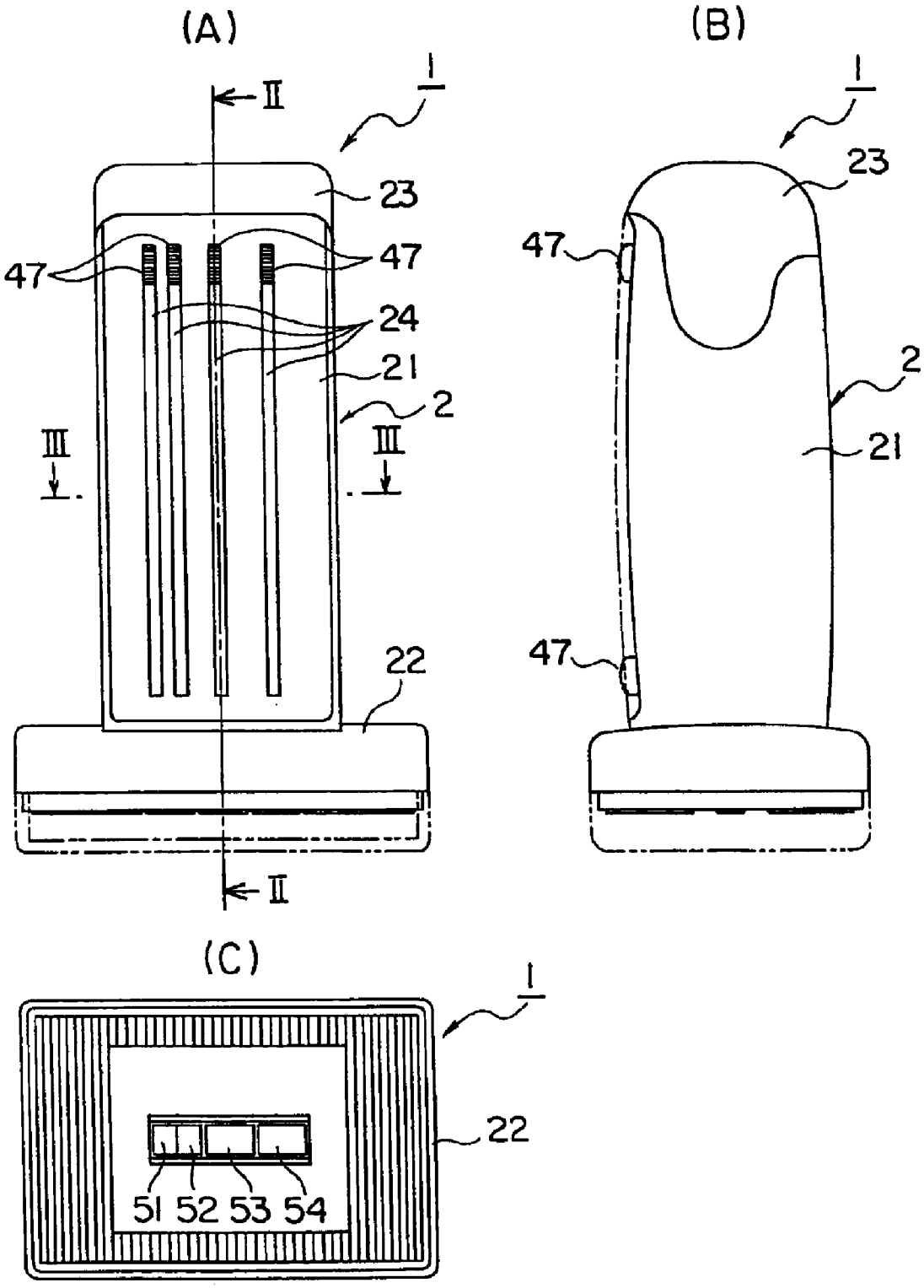
FIG. 1A to FIG. 1C are views from three viewpoints of a stamp according to an embodiment of the present invention.
Figure 6:
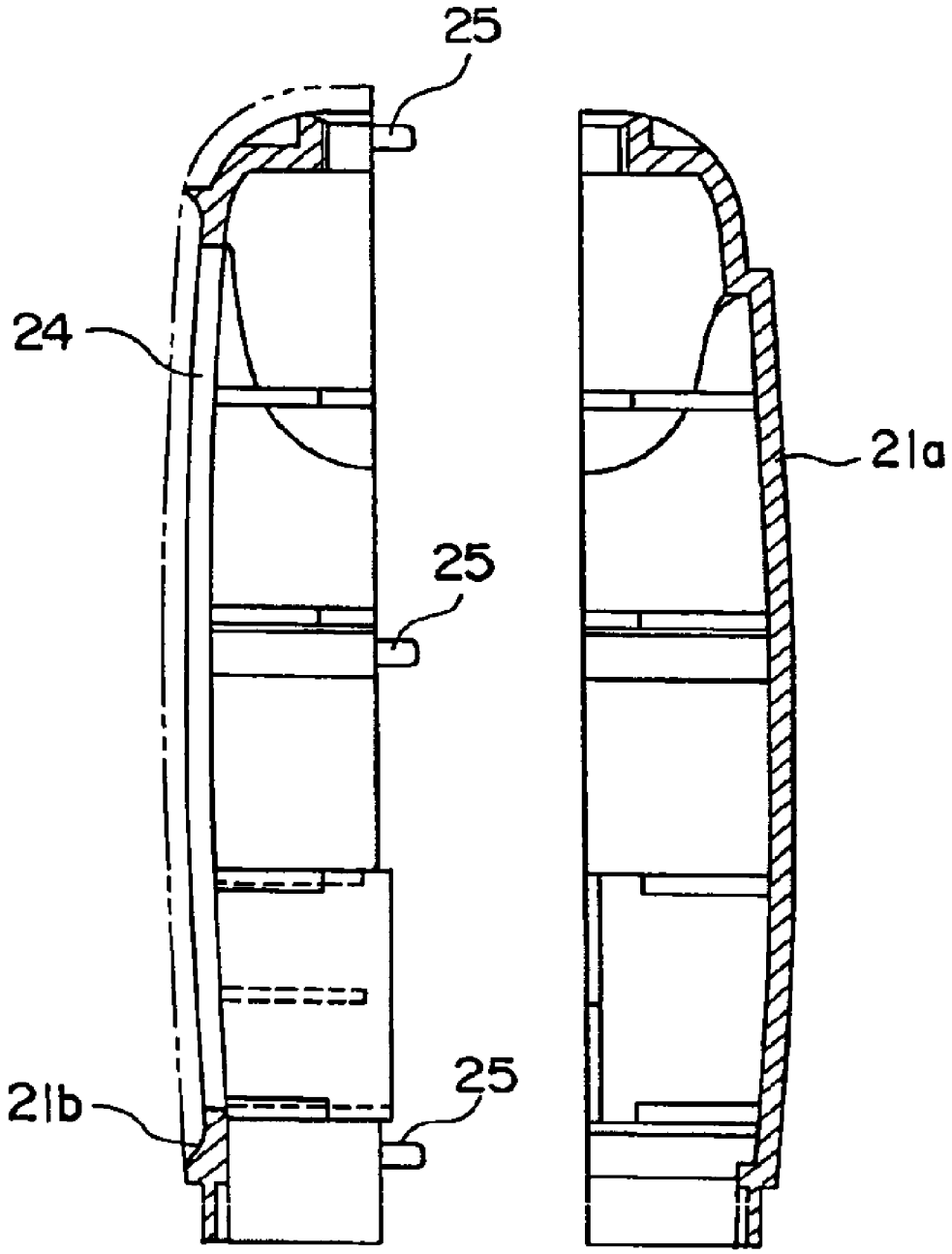
FIG. 6 is a cross-sectional view of a stamp case according to the present invention.

First, the stamp 1 of the present embodiment comprises a stamp case 2 comprised of a grip 21, a stamping portion 22 and a head cap 23. The grip 21 is, as shown in FIG. 1B and FIG. 6, formed by vertically divided two portions 21*a* and 21*b*, which are fit together for assembling. A protrusion 25 formed on one grip portion 21*b* in FIG. 6 fits in a recessed portion (not shown) of the other grip portion 21*b*, so that the two are assembled.

Figure 4:
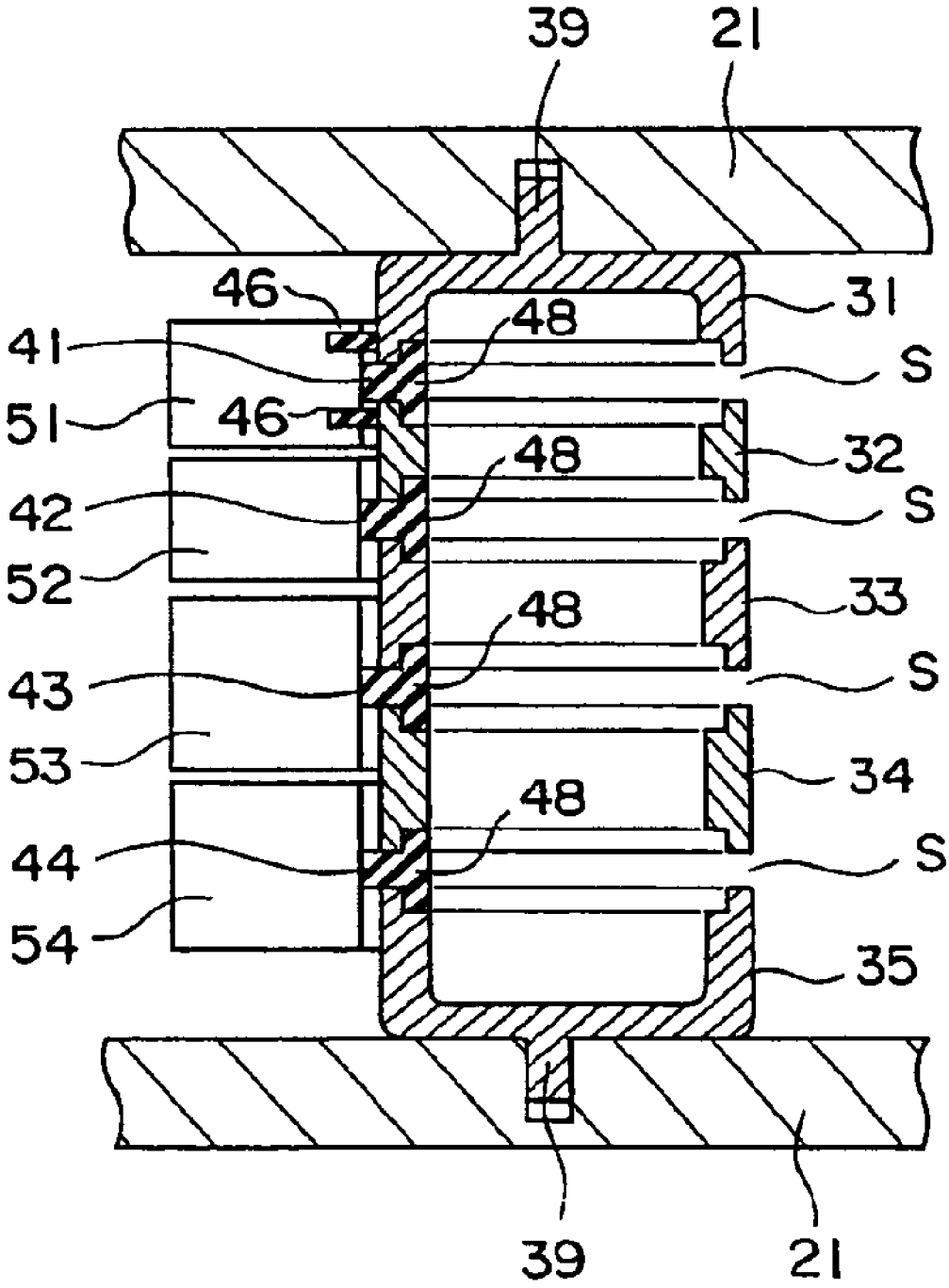
FIG. 4 is an enlarged cross-sectional view of the IV portion in FIG. 3.
Figure 5:
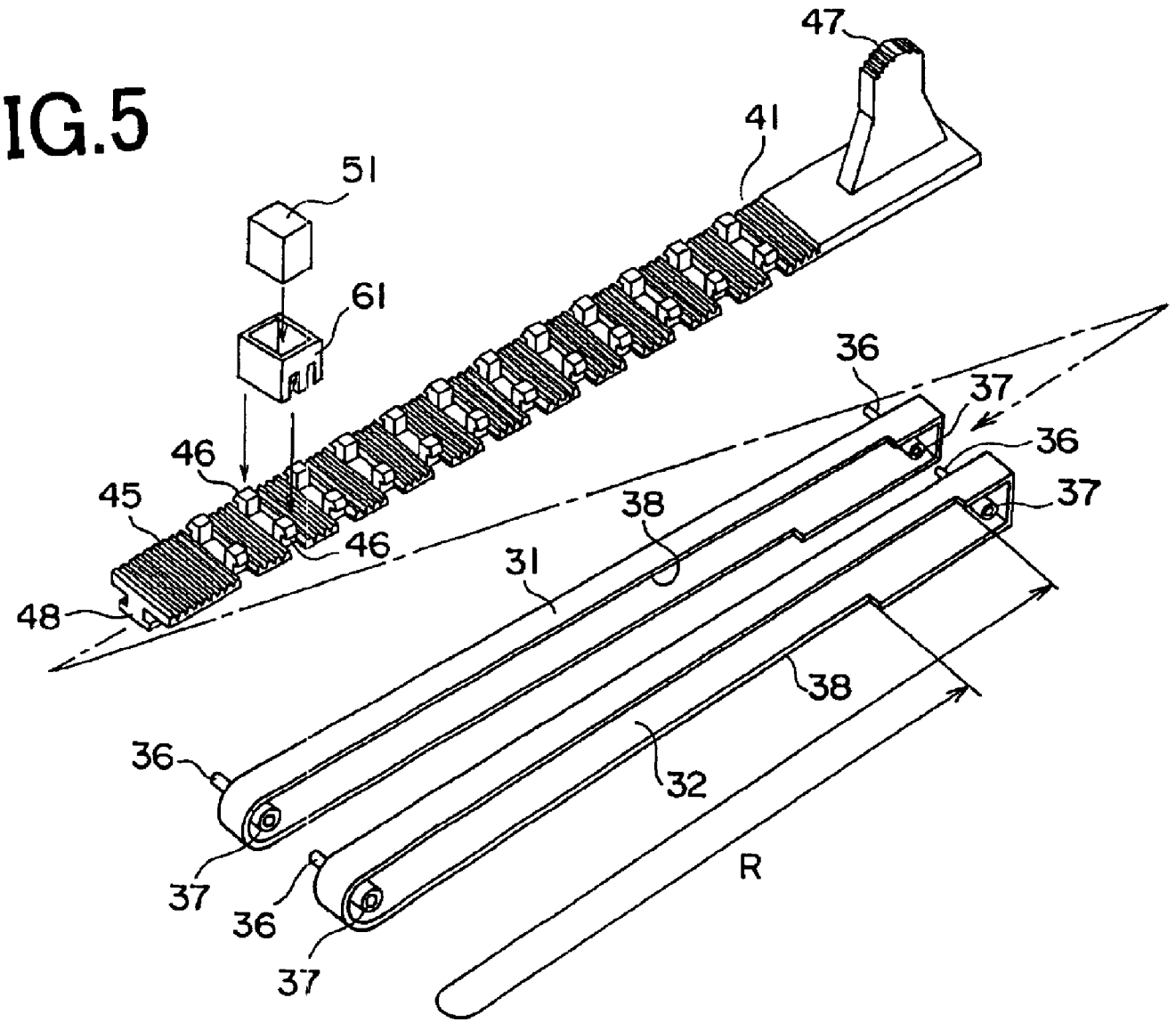
FIG. 5 is a disassembled perspective view of a belt and a rail according to the present invention.
Figure 7:
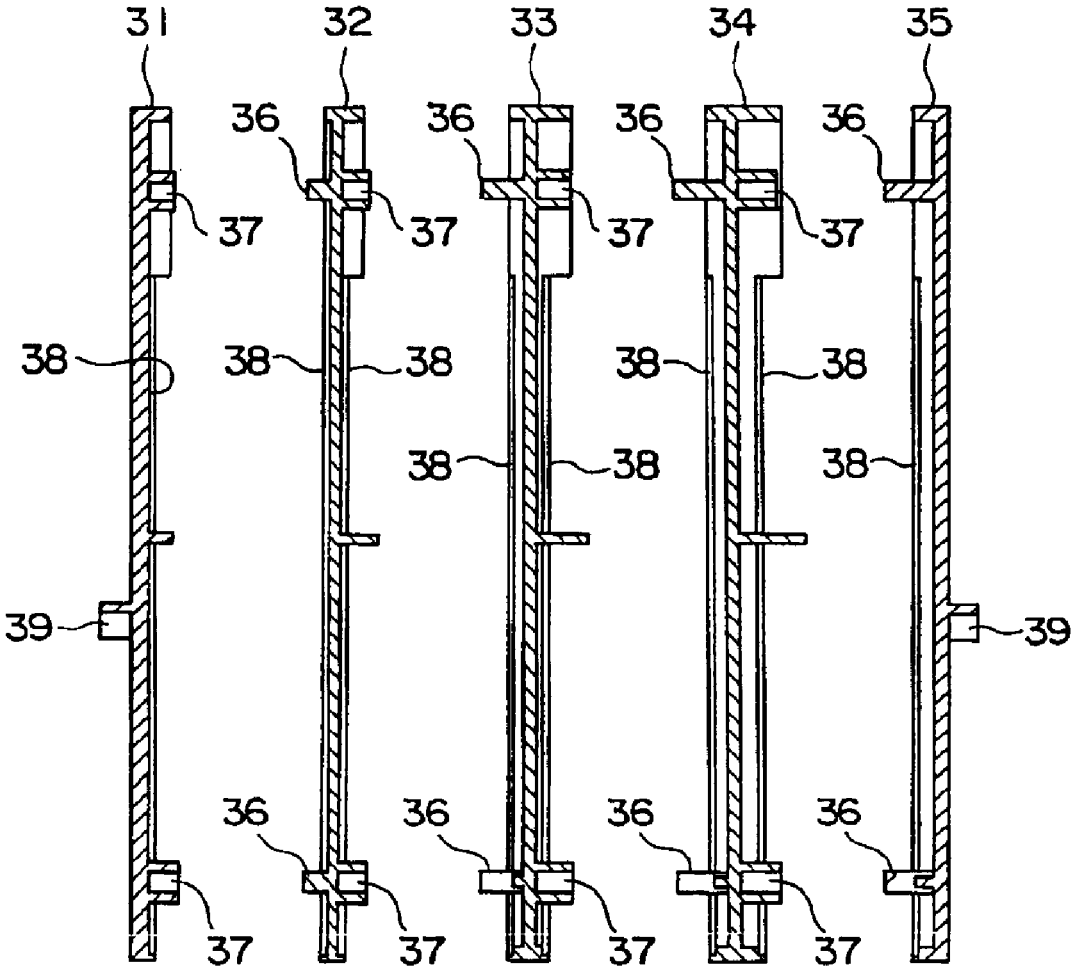
FIG. 7 is a cross-sectional view of a rail according to the present invention.
Figure 8:
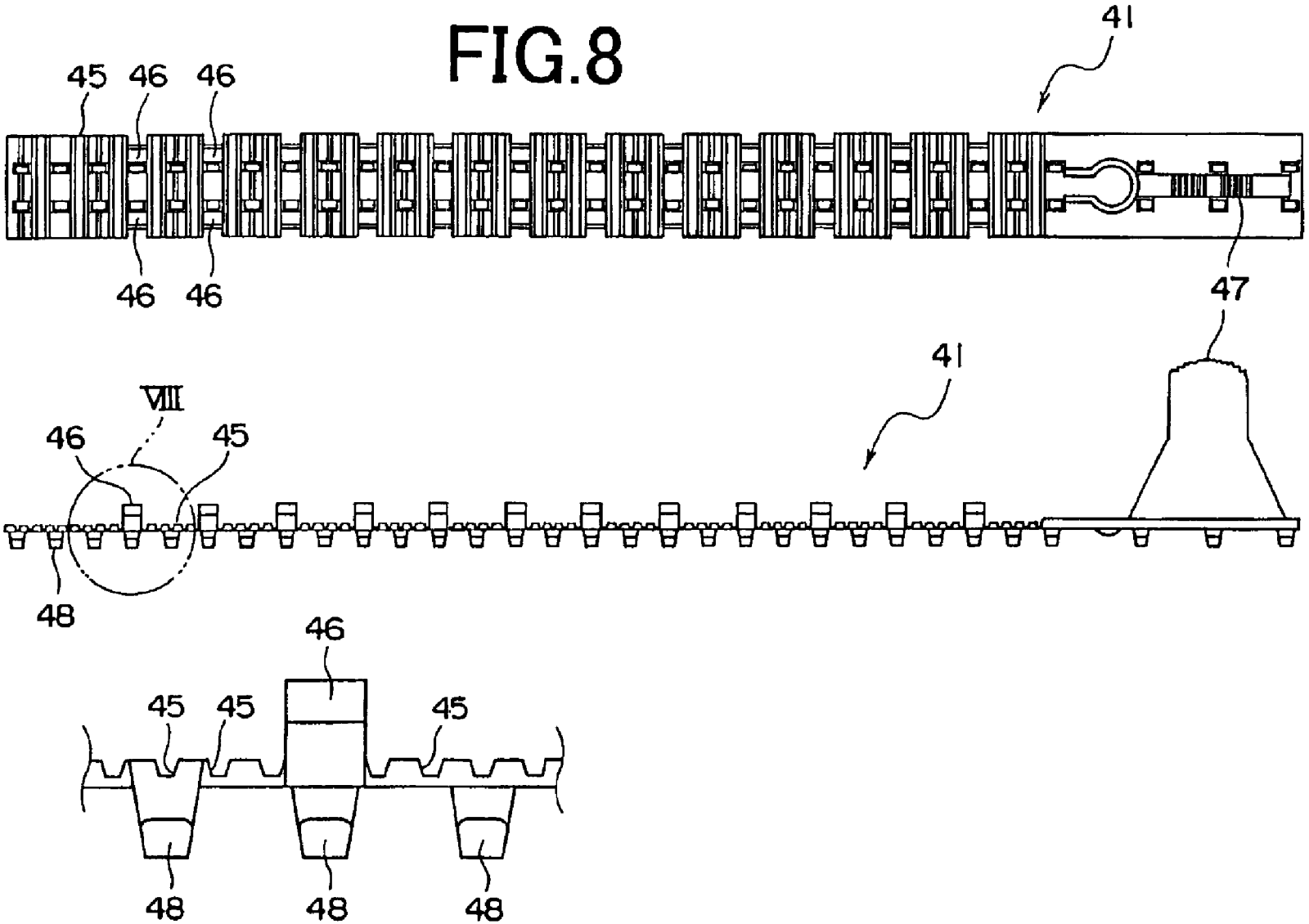
FIG. 8 shows a plan view, a view from a side and an enlarged view from the side of the belt according to the present invention.

Furthermore, inside the stamp case 2 is provided with a rail 3 comprised of five sub rails 31 to 35 shown in FIG. 4, FIG. 5, FIG. 7 and FIG. 8 and a belt 4 comprised of four sub belts 41 to 44 engaged with the rail 3. FIG. 4 shows a state where five sub rails 31 to 35 and the four sub belts 41 to 44 are fit together, FIG. 5 shows only one belt 41 and two rails 31 and 32 among them, FIG. 7 is a cross-sectional view of the five sub rails 31 to 35, and FIG. 8 shows one belt in detail.

With reference to an overall cross-sectional view in FIG. 2, a key portion cross-sectional view in FIG. 4, a disassembled perspective view in FIG. 5, a cross-sectional view of the rail in FIG. 7 and a view of the belt in detail in FIG. 8, detailed configurations of the rail 3 and the belt 4 according to the present invention and their relationship with the stamp case 2 will be explained.

As shown in FIG. 5 and FIG. 8, the sub belt 41 according to the present embodiment is a strip belt wherein both ends are not connected (not closed) and made by an elastic material, such as polyester elastomer or rubber. As will be explained later on, the sub belt 41 is inserted along the rail 3 and formed trenches 45 for giving flexibility at regular intervals so that the sub belt 41 can make U-turn at a stamping portion 22 as shown in FIG. 2. Also, as shown in FIG. 5 and FIG. 8, one main surface of the sub belt 41 is formed nails 46 for mounting a stamping surface holder 61 at regular intervals. As a result that the nails 46 engages with nails 62 of the stamping surface holder 61, the stamping surface 51 mounted on the stamping surface holder 61 is fixed to the sub belt 41 at regular intervals. Note that the stamping surface 51 is inserted to the stamping surface holder 61 and fixed by using an adhesive, etc.

Figure 2:
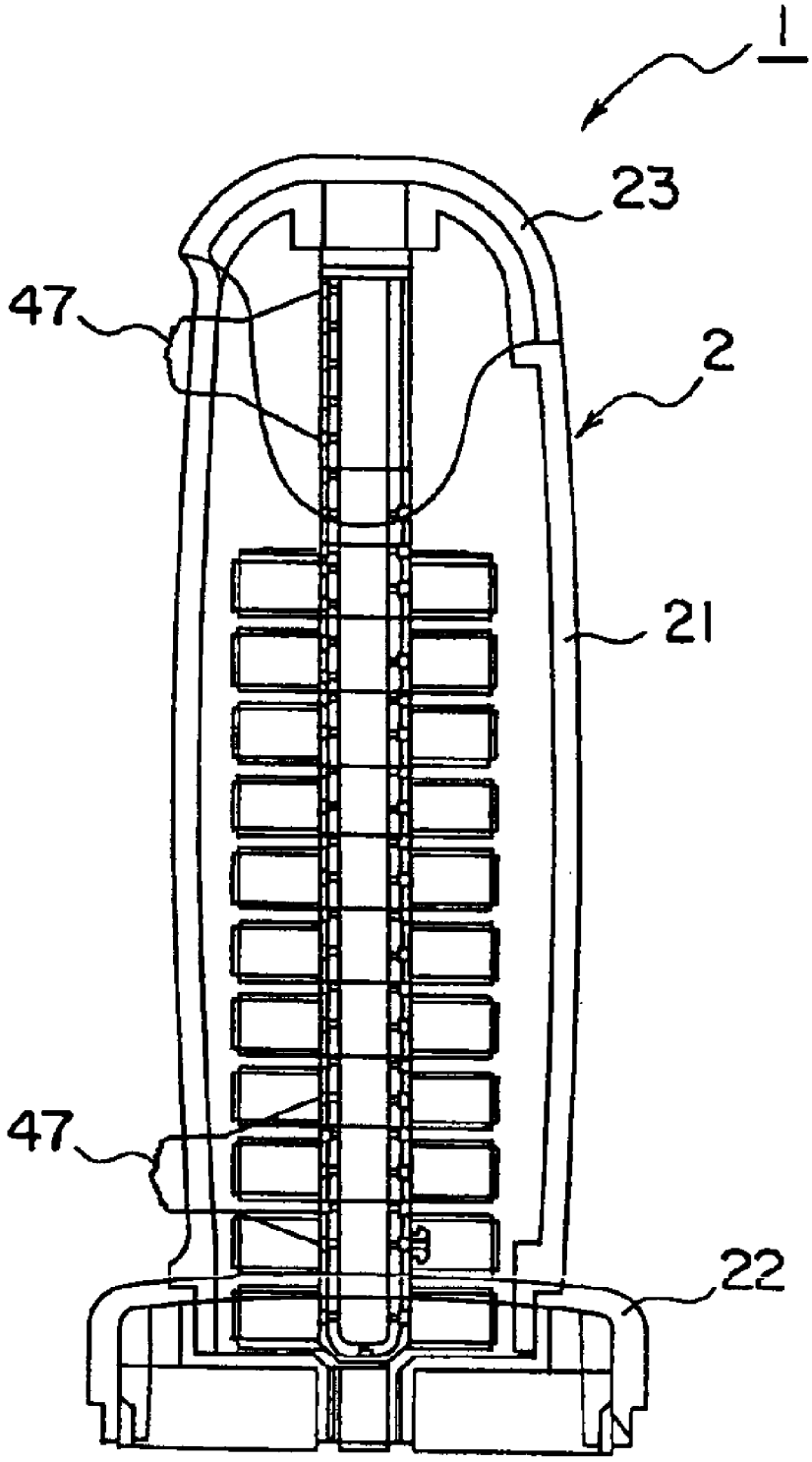
FIG. 2 is a cross-sectional view along the line II—II in FIG. 1A.
Figure 3:
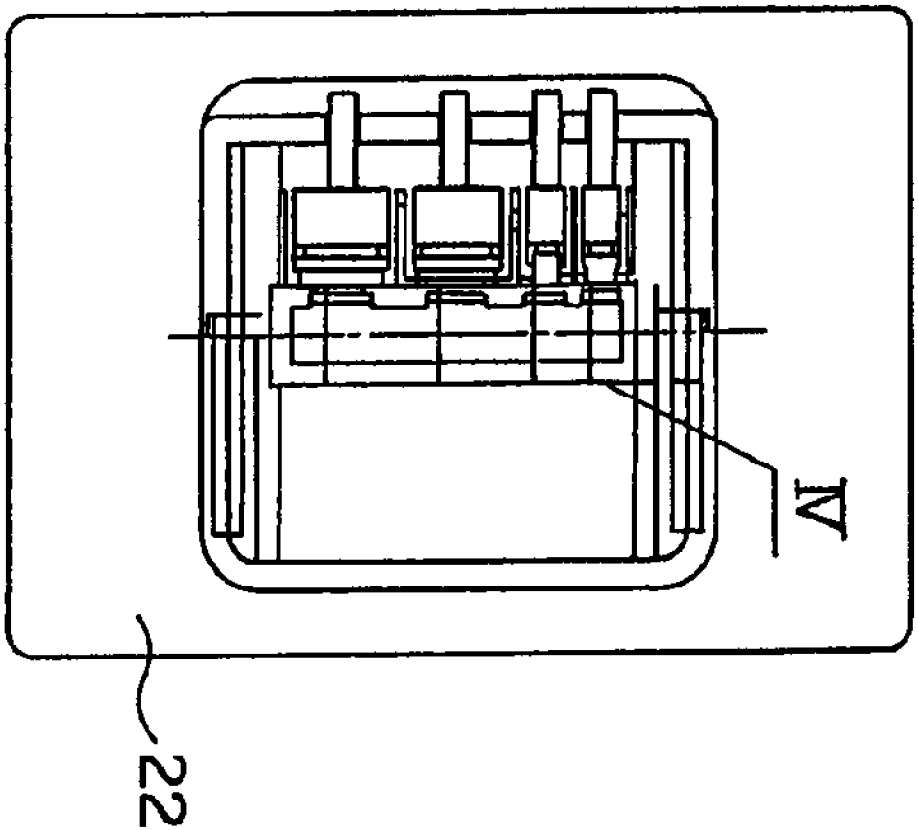
FIG. 3 is a cross-sectional view along the line III—III in FIG. 1A.

Furthermore, one end of a main surface identical with the main surface being mounted the stamping surface 51 of the sub belt 41 is formed a tab 47, which, as shown in FIG. 1A, FIG. 1B and FIG. 2, protrudes outside from a slit portion 24 formed in a longitudinal direction on a grip 21 of the stamping case 2, so that a user can select the stamping surface 5 positioned at the stamping portion 22 by touching the tab 47 to slide with a finger.

On the other hand, on an opposite main surface of the sub belt 41 is provided with projections 48 having a T-shaped section at intervals along the longitudinal direction. The projections 48 engage with a later explained space S formed between the sub rails 31 and 32. As a result, the sub belt 41 is guided along the rails 31 and 32 to be able to slide.

The rail 3 is comprised of five sub rails 31 to 35 being combined. FIG. 5 shows only two sub rails 31 and 32 among them and FIG. 7 shows the five sub rails 31 to 35. Each of the sub rails 31 and 32 having a shape as shown in FIG. 5 and FIG. 7 is formed projections 36 on one main surface while recesses 37 for receiving the projections 36 are formed on the other main surface near its both ends. By the projections 36 and the recesses 37, the five sub rails 31 to 35 are combined and assembled as shown in FIG. 4. The sub rails 31 and 35 positioned at both edges of the combined five sub rails are formed projections 39 for fitting in holes formed on a wall of the grip 21.

Also, as shown in FIG. 5 and FIG. 7, a notch 38 is formed on the respective sub rails 31 to 35. When combining the adjacent sub rails 31 and 32, the notches 38 form a space S (refer to FIG. 4) with witch the above projections 48 of the sub belt 41 are engaged. Note that a range of the notch 38 is made to be a range of R shown in FIG. 5 in the present embodiment, and by setting an end as such, the notch 38 also serves as a stopper of a sliding movement of the belt 4. Note that the stopper function for the sliding movement of the belt 4 may belong to the tab 47 and the slit portion 24 of the grip 21.

To assemble the stamp 1 configured as above, the following processes are taken.

First, as shown in FIG. 5, the notch 38 of one of sub rails positioned at both edges (the sub rail 31 in the present embodiment) is engaged with the projection 48 of a sub belt (the sub belt 41 in the present embodiment) corresponding to the sub rail 31 by bending the sub belt 41 to be a U-shape for setting.

Next, the adjacent sub rail 32 is fit to the sub rail 31 which is half-engaged with the projection 48 of the sub belt 41. As a result, the sub belt 41 is supported by being sandwiched by the two sub rails 31 and 32, and the projection of the sub belt 41 is engaged with the space S between the two sub rails 31 and 32 formed by the notches 38 so that sliding becomes possible.

Furthermore, next sub belt 42 is bent for being set in a notch 38 formed on the opposite main surface of the sub rail 32, so that the adjacent sub rail 33 is fit. Then, the same procedure is taken for setting the sub belts 43 and 44 and sub rails 34 and 35. Consequently, an assembled article wherein four sub belts 41 to 44 are supported by being sandwiched between five sub rails 31 to 35 is completed.

The completed assembled article of the sub rails and sub belts is set in grip portions 21*a* and 21*b* of the stamping case 2 longitudinally divided into two shown in FIG. 6, then the grip portions 21*a* and 21*b* are fit together. The grip 21 is inserted to the stamping portion 22 and a head cap is put thereon, so that the stamp 1 of the present embodiment is completed.

Note that the stamping portion 22 is not essential for the stamp 1 of the present invention and only the grip 21 can be used for stamping.

The stamping surface of desired figures, etc. can be selected by looking at the stamping surface appearing at the stamping portion 22 and sliding the tab 47 protruded from the grip 21.

Note that the embodiments explained above were described to facilitate the understanding of the present invention and not to limit the present invention. Accordingly, elements disclosed in the above embodiments include all design modifications and equivalents belonging to the technical field of the present invention.

According to the stamp of the present invention, assembling can be easily done only by inserting strips of belts into rails, which attains remarkable improvement of assembling performance comparing with ring belts of the related art wherein the belts are fit to a supporting base while being strained.

Also, since no additional tension affects on the belts, the belts do not degraded and the durability improves.

Furthermore, since a sliding operation of a belt is controlled only by a friction force of the belt and the rail, light sliding becomes possible and operationality at the time of selecting a desired stamping surface remarkably improves.

What is claimed is:

1. A stamp, comprising:

a stamping case;

a rail provided inside said stamping case, having a locus of making a U-turn on a stamping surface of a stamp; and a strip belt for sliding along said rail by being engaged with the rail, attached a plurality of stamping surfaces at predetermined intervals and provided with a tab protruding outside of said stamping case, wherein a first end of said strip belt is not connected to a second end of said strip belt.

2. The stamp as set forth in claim 1, wherein said rail is assembled by combining a plurality of divided sub rails.

3. The stamp as set forth in claim 2, wherein said strip belt is comprised of a plurality of sub belts to be engaged with said respective sub rails.

* * * * *